US006792705B2

(12) United States Patent
Cartabbia

(10) Patent No.: US 6,792,705 B2
(45) Date of Patent: Sep. 21, 2004

(54) IRONING DEVICE FOR UNCREASED-TROUSERS IRONING MACHINES INCLUDING MEANS FOR IRONING THE TROUSERS BOTTOM PORTION

(76) Inventor: Giovanni Cartabbia, Via Piantada, 9/A, 25036 Palazzolo Sull'Oglio (Brescia) (IT)

( * ) Notice: Subject to any disclaimer, the term of this patent is extended or adjusted under 35 U.S.C. 154(b) by 0 days.

(21) Appl. No.: 10/623,976

(22) Filed: Jul. 21, 2003

(65) Prior Publication Data

US 2004/0079770 A1 Apr. 29, 2004

(30) Foreign Application Priority Data

Oct. 25, 2002 (IT) ..... MI2002A2282

(51) Int. Cl.[7] ..... D06F 71/28
(52) U.S. Cl. ..... 38/12; 38/14; 223/73
(58) Field of Search ..... 38/1 R, 12, 14, 38/15, 16, 1 B, 69, 70, 71; 223/52, 66, 67, 72, 73, 74, 75, 76; 34/103, 104, 106

(56) References Cited

U.S. PATENT DOCUMENTS

| | | | | |
|---|---|---|---|---|
| 3,208,652 A | * | 9/1965 | Zimmermann | 223/73 |
| 3,823,854 A | * | 7/1974 | Everett | 223/73 |
| 4,479,314 A | * | 10/1984 | Frushtick | 38/42 |
| 4,483,467 A | * | 11/1984 | Hostetler et al. | 223/74 |
| 5,361,516 A | * | 11/1994 | Dahman | 34/440 |
| 5,711,097 A | * | 1/1998 | Mino | 38/21 |

* cited by examiner

*Primary Examiner*—Ismael Izaguirre
(74) *Attorney, Agent, or Firm*—Hedman & Costigan, P.C.

(57) ABSTRACT

The present invention relates to an iron device to be applied to ironing machine for ironing uncreased-trousers, the device comprising a supporting framework which supports an ironing head including trousers support elements as well as trousers bottom gripping elements, the ironing device further comprising a steaming drum coupled to a heating circuit for heating the trousers bottom gripping elements and a steaming duct coupled to the gripper elements.

20 Claims, 8 Drawing Sheets

IRONING DEVICE FOR UNCREASED-TROUSERS IRONING MACHINES INCLUDING MEANS FOR IRONING THE TROUSERS BOTTOM PORTION

BACKGROUND OF THE INVENTION

The present invention relates to an ironing device for uncreased-trousers ironing machines, which ironing device includes means for ironing the trousers bottom portion.

Prior trousers ironing machines conventionally comprise a supporting framework, including means for supporting the trousers at the pelvis level and gripping means which, in operation, close the bottom portions of the trousers legs.

Uncreased or crease-free trousers are conventionally ironed by blowing water steam and hot air inside said trousers, which are suitably stretched in order to be evenly ironed through the overall surface thereof.

The above mentioned trousers ironing machines, however, even they allow to satisfactorily iron uncreased trousers, have, on the other hand, the great drawback that they do not allow to proper iron the bottom portions of the trousers leg, in particular at the regions thereof where operate the mentioned gripper elements.

In fact, as it is known, conventional trousers gripping means do not include heating and steaming devices.

Thus, in prior ironing machines, the trousers pair, after a starting ironing operation, must be necessarily further ironed, by using a conventional flatiron, or a pressing ironing apparatus, for properly ironing the bottom portions of the trousers legs.

SUMMARY OF THE INVENTION

Accordingly, the aim of the present invention is to overcome the above mentioned drawbacks, by providing an ironing device, to be applied to ironing machines for ironing crease-free or uncreased trousers, allowing to properly iron, in a single operation, the trousers pair through the overall surface thereof.

Within the scope of the above mentioned aim, a main object of the present invention is to provide such an ironing device allowing to fully iron a trousers pair in a single operation, and with optimum ironing temperatures.

Another object of the present invention is to provide such an ironing device, which, due to its specifically designed constructional features, is very reliable and safe in operation.

Yet another object of the present invention is to provide such an ironing device which can be easily made and which, moreover, is very competitive from a mere economic standpoint.

According to one aspect of the present invention, the above mentioned aim and objects, as well as yet other objects, which will become more apparent hereinafter, are achieved by an ironing device, to be applied to uncreased trousers ironing machines, said iron device including ironing means for ironing the bottom portions of the trousers, and including a supporting frameworks supporting at least an ironing head including supporting means for supporting said trousers at the pelvis level thereof and gripping means for gripping the bottom portions of the trousers, and being characterized in that said device further comprises a steaming drum coupled to a heating circuit for heating said gripping means and to a steaming duct coupled to said gripping means.

BRIEF DESCRIPTION OF THE DRAWINGS

Further characteristics and advantages of the present invention will become more apparent hereinafter from the following detailed disclosure of an ironing device to be applied to uncreased trousers ironing machines, said ironing device including means for ironing the bottom portions of the trousers, and being illustrated, by way of an indicative, but not limitative example, in the accompanying drawings, where.

DESCRIPTION OF THE PREFERRED EMBODIMENTS

Figure 2:
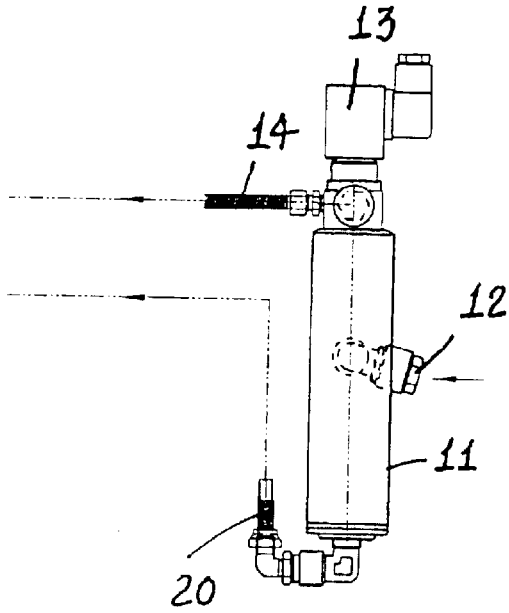
FIG. 2 is a schematic view showing the steaming drum included in the ironing device according to the invention.
Figure 1:
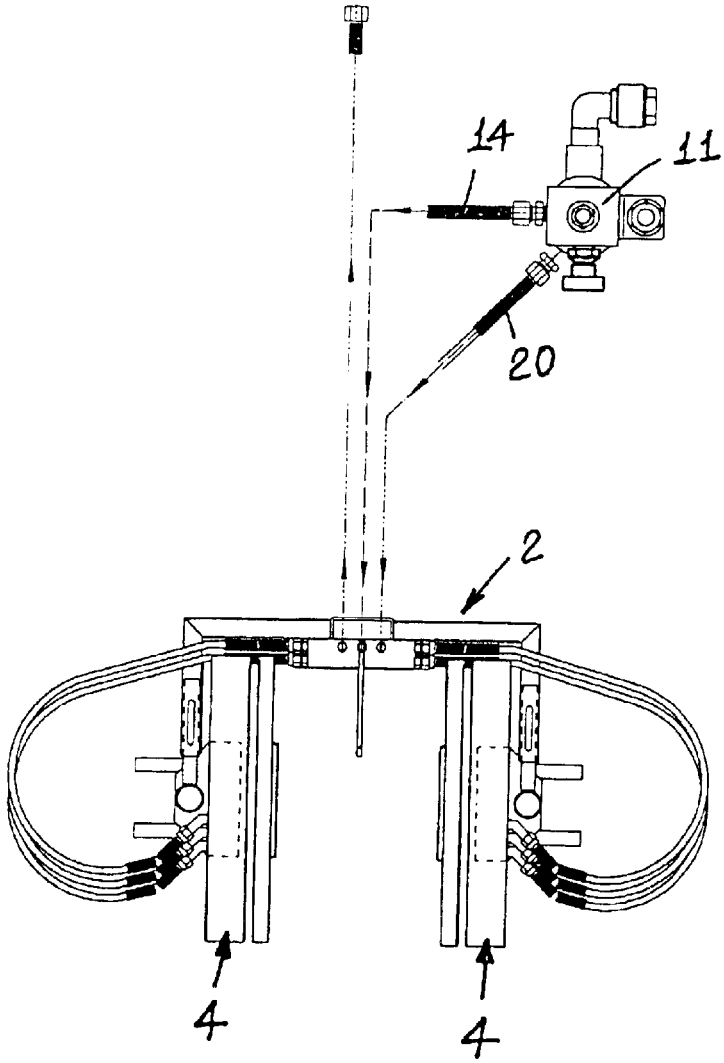
FIG. 1 is a schematic top plan view illustrating the ironing device according to the present invention applied to a trousers ironing machine including a single ironing head.
Figure 5:
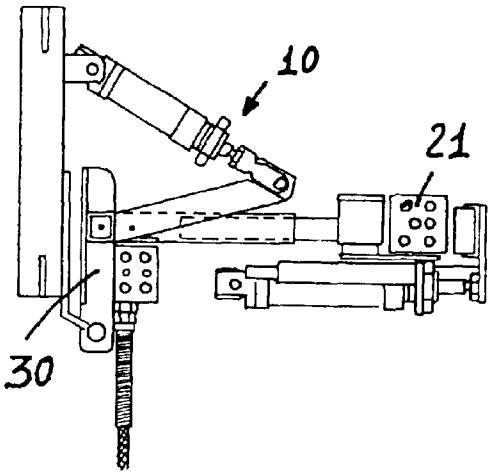
FIG. 5 is a side elevation view illustrating the gripping means.
Figure 3:
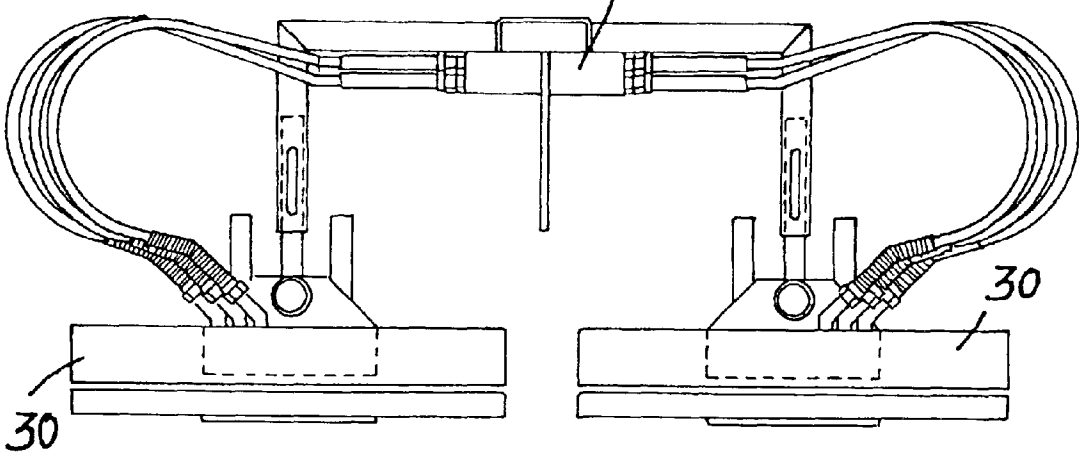
FIG. 3 is a further top plan view illustrating gripping means for gripping the bottom portions of the trousers.
Figure 4:
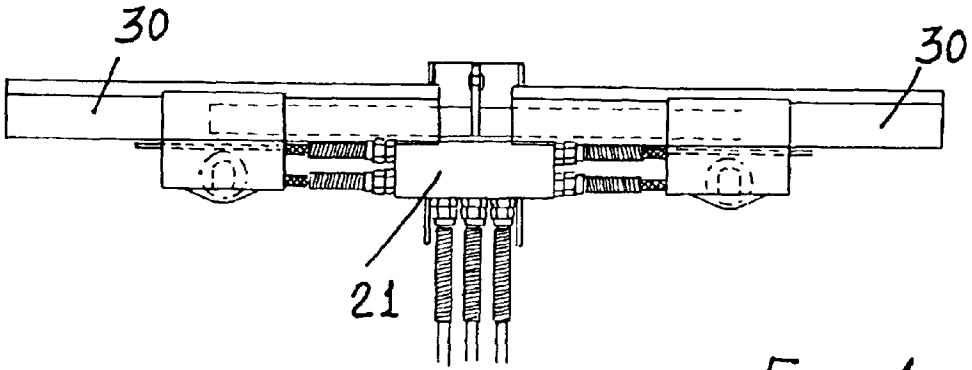
FIG. 4 is a front elevation view illustrating the trousers gripping means.
Figure 6:
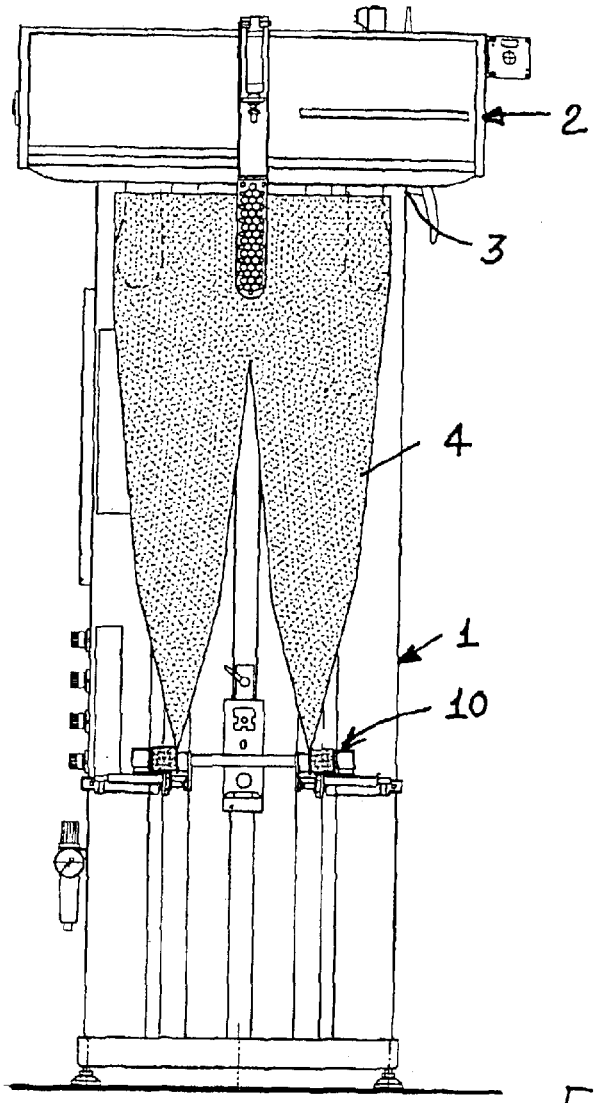
FIG. 6 is an elevation view illustrating an ironing machine including a single ironing head, during a trousers ironing operation.
Figure 7:
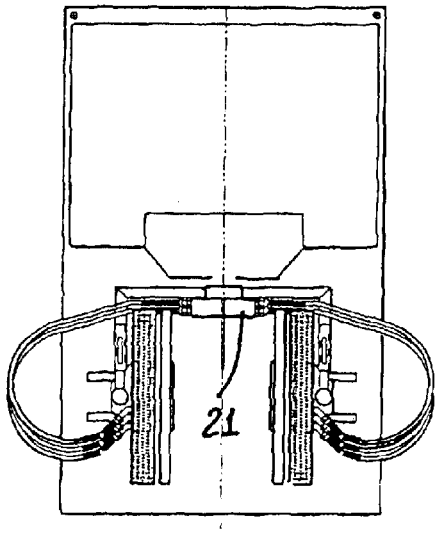
FIG. 7 is a top plan view illustrating the single head machine shown in FIG. 6.
Figure 9:
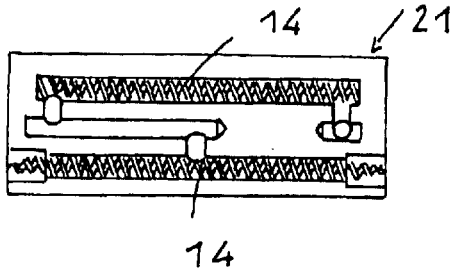
FIG. 9 illustrates the delivery manifold and the steaming duct.

With reference to the number references of the above mentioned figures, the ironing device, to be applied to ironing machines for ironing uncreased or crease-free trousers, and including ironing means for ironing the bottom portions of the leg of the trousers, comprises a supporting framework, generally indicated by the reference number 1, which can be made with several arrangements and, for example, can comprise a single ironing head, generally indicated by the reference number 2, as is shown in FIGS. 1 to 7 or, if desired, two opposite ironing heads, as shown in FIGS. 13 to 16, or also four ironing heads, evenly circumferentially distributed and continuously movable, as is clearly shown in FIGS. 17 to 20.

At each ironing head, conventional supporting means for supporting the trousers 4 are provided, said supporting means operating at the trousers pelvis.

Moreover, at the bottom portions of the trousers legs are provided gripping means, which are generally indicated by the reference number 10.

The main feature of the invention is that a steaming drum 11 is provided, which communicates with a steam supplying duct 12.

At the top portion of the steaming drum 11, are moreover provided solenoid valves 13, the number of which will depend on the number of the ironing heads provided on the ironing machine.

The mentioned solenoid valves 13 control a steaming duct, which is generally indicated by the reference number 14.

To the bottom of the steaming drum 11 is coupled a heating circuit, including a duct 20 for supplying steam to a delivery manifold, generally indicated by the reference number 21.

The overheated steam delivery manifold, in particular, is provided for conveying steam to the mentioned gripping means and, more specifically, to a left and right pressing elements 30 associated with the mentioned gripping means 10.

Figure 8:
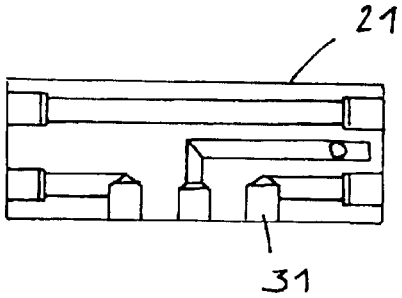
FIG. 8 is a schematic broken-away view illustrating the delivery manifold, and further clearing showing the heating circuit for heating the trousers bottom gripping means.
Figure 10:
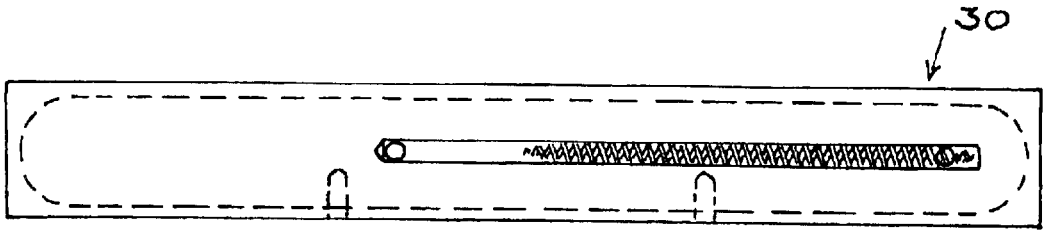
FIG. 10 shows the trousers bottom gripping means and the steaming circuit at the inlet portion thereof.
Figure 11:
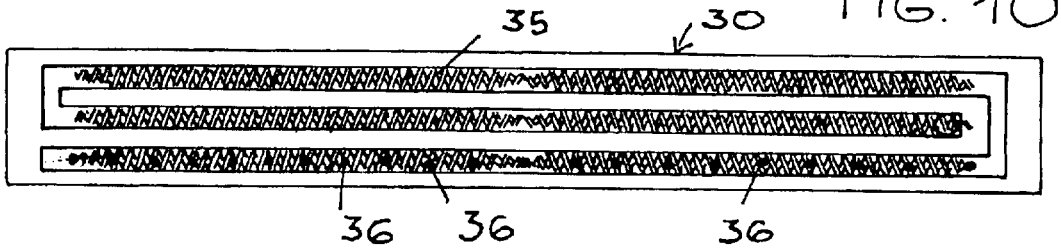
FIG. 11 shows the trousers bottom gripping means and the steaming duct and related outlet means.

In the steam circuit shown in FIG. 8, steam is circulated under pressure inside one of said pressing elements and then it exits said pressing element 30, and returns to the steam manifold 21 and, from the latter, it is conveyed to the other pressing element 30 where it is circulated for heating it and then returned to said steam manifold 21.

From said steam manifold 21, steam is conveyed to a condensate discharging duct, generally indicated by the reference number 31, provided for ejecting condensate to the outside environment.

Inside said steam manifold 21 is moreover provided a steaming duct, generally indicated by the reference number 14, supplying steam to the two pressing elements 30.

Said pressing elements comprise, in their inside, a steam overheating circuit 35, with steam outlet holes 36, arranged on the longitudinal extension of the pressing element 30.

Figure 12:
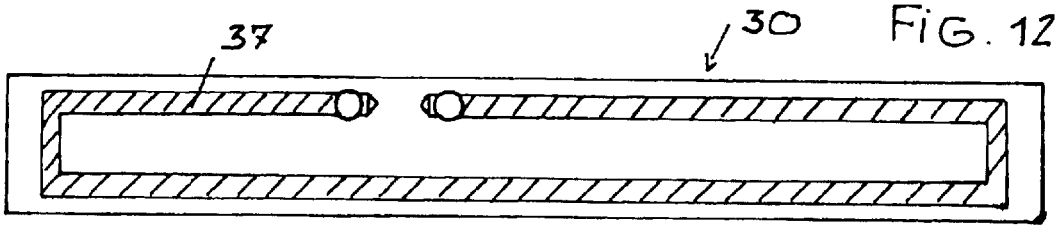
FIG. 12 is a further schematic view showing the trousers bottom gripping means and the heating circuit therefor.
Figures 13, 14:
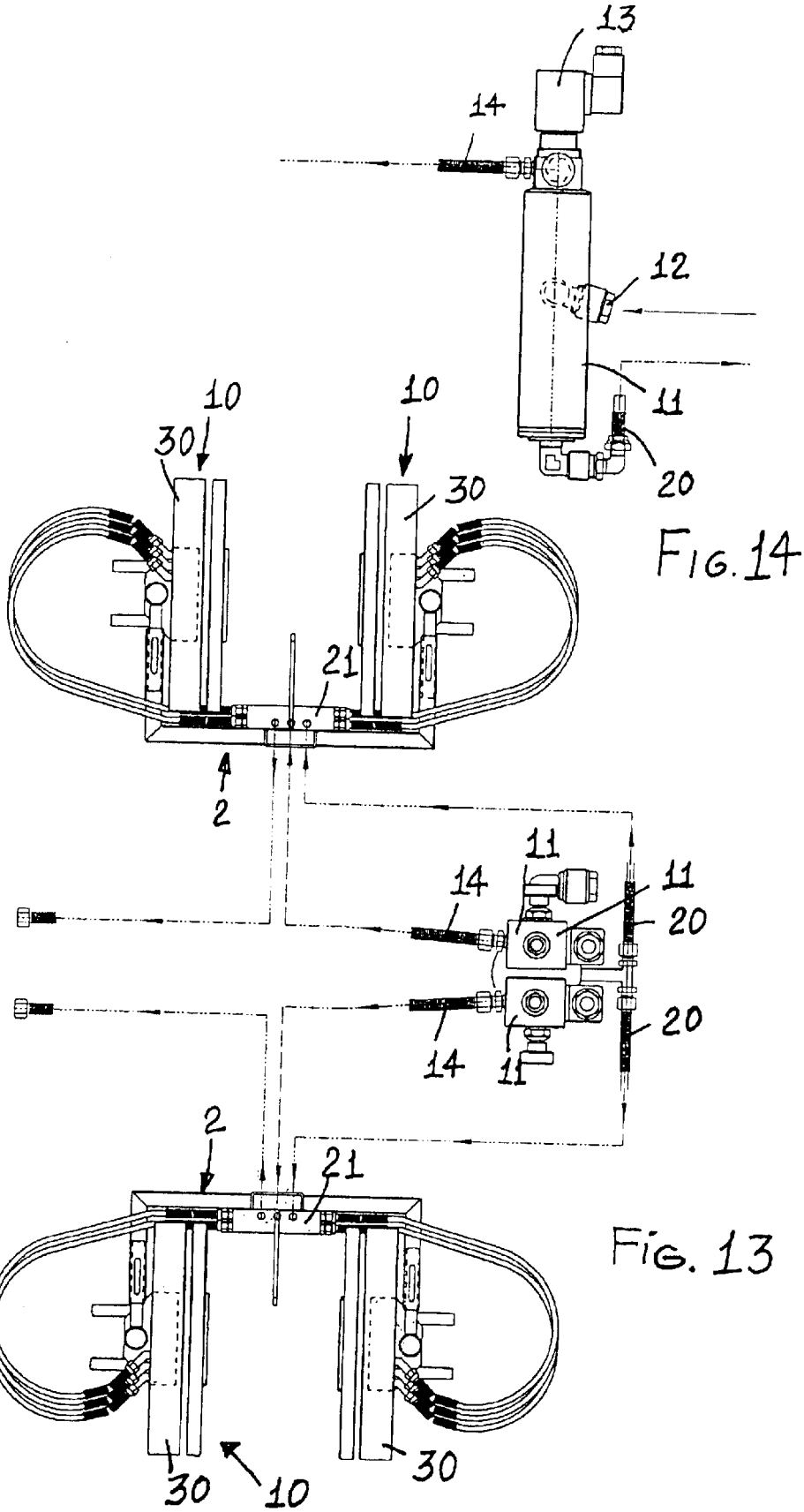
FIG. 13 is a further schematic top plan view illustrating an ironing machine including two opposite ironing heads.
FIG. 14 illustrates the steaming drum of a two-head ironing machine.
Figure 15:
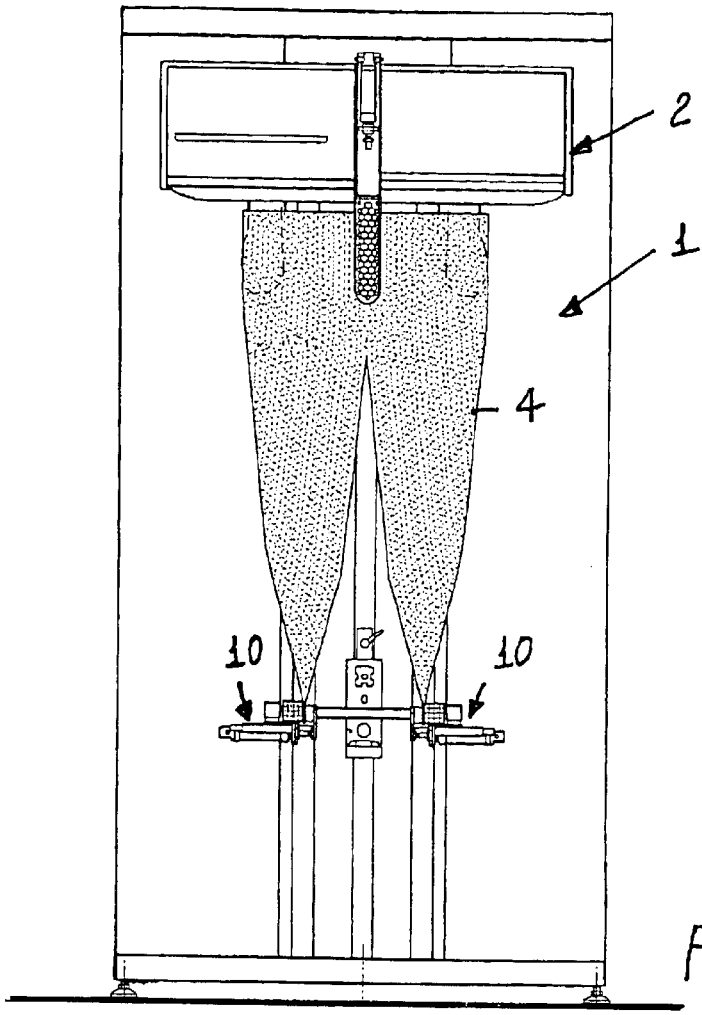
FIG. 15 is a front elevation view illustrating a two-head ironing machine, during a trousers ironing operation.
Figure 16:
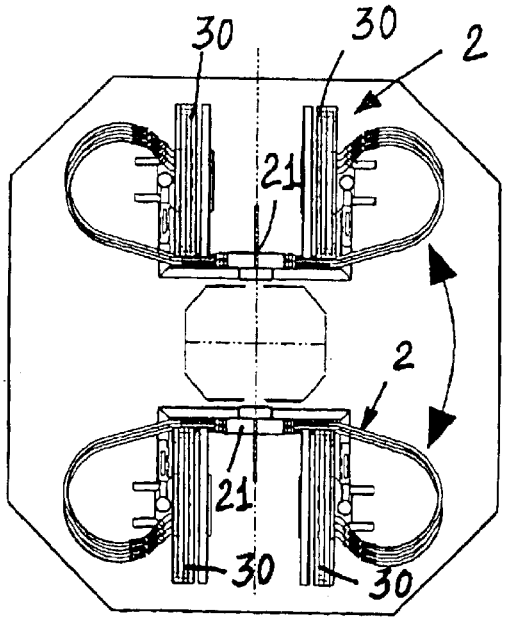
FIG. 16 is a schematic top plan view illustrating the two-head ironing machine.
Figure 18:
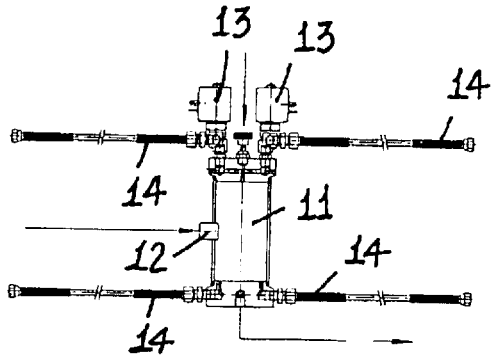
FIG. 18 schematically shows the steaming drum of a four-head ironing machine.
Figure 17:
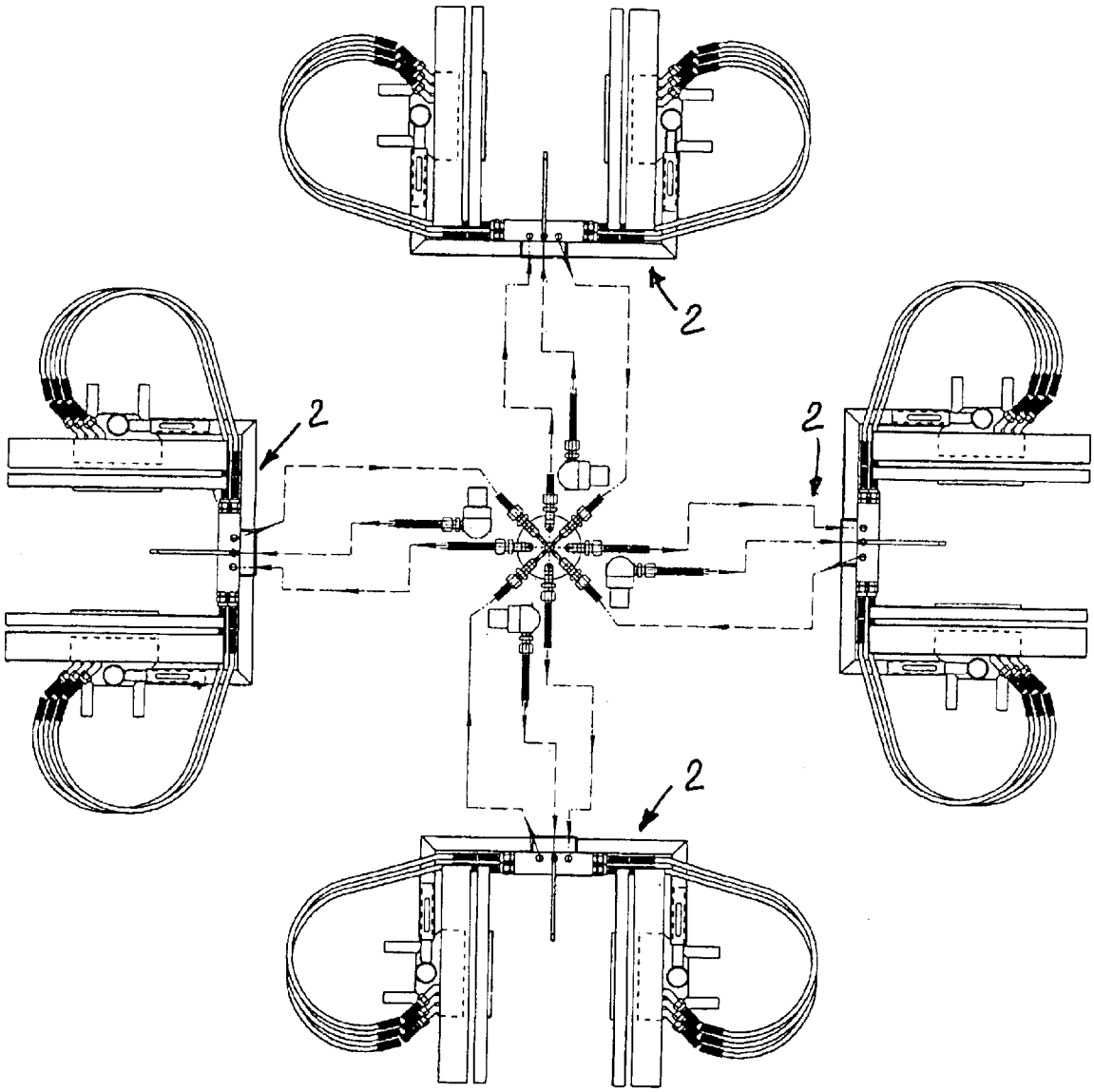
FIG. 17 is a schematic view illustrating the circuitry of a four-head ironing machine.
Figure 19:
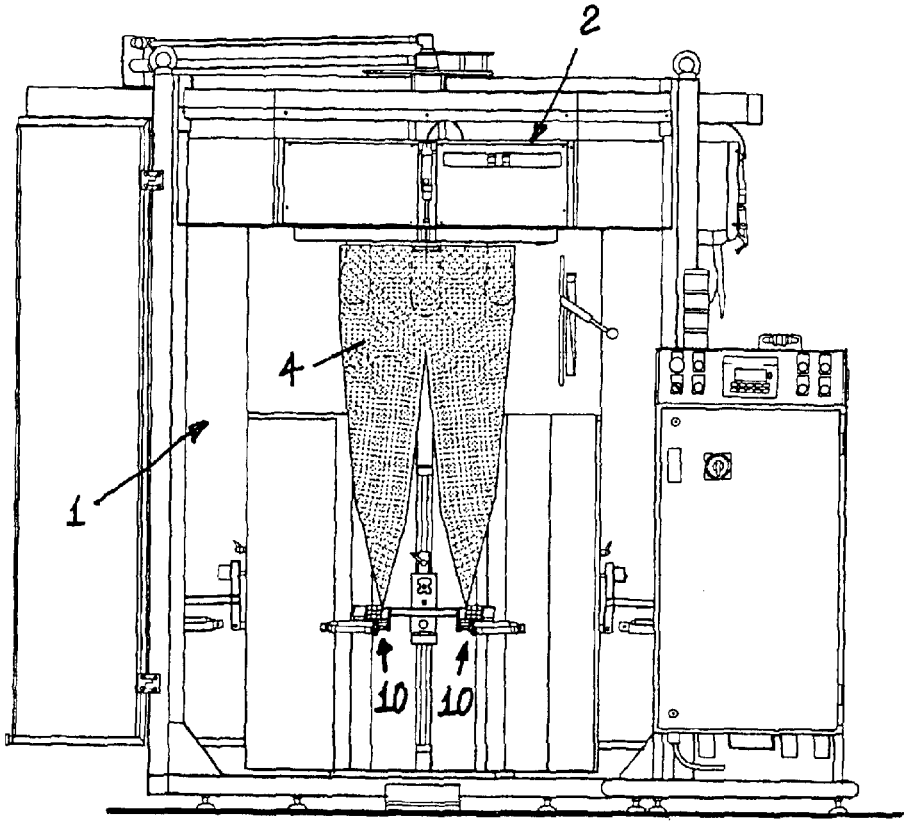
FIG. 19 is a further schematic elevation view illustrating the ironing operation of a four-head ironing machine.
Figure 20:
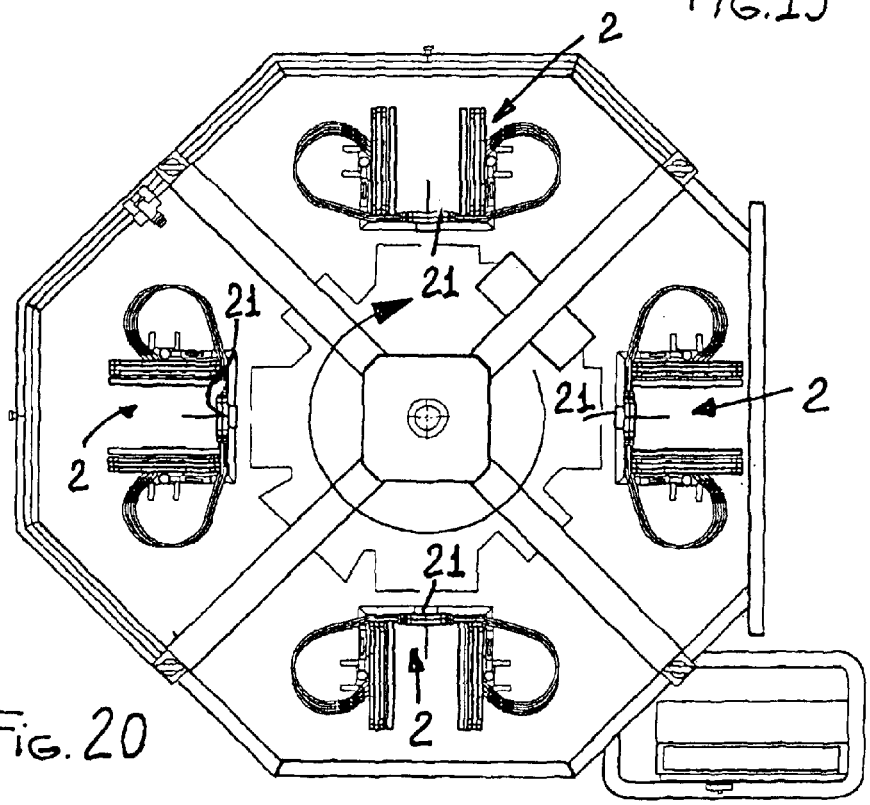
FIG. 20 is a top plan view illustrating the four-head ironing machine.

As is clearly shown in FIG. 12, each pressing element 30 is held in a heated condition, by causing overheated steam to pass through the overheating duct 37, which are supplied with steam at a pressure from 4 to 6 atm so as to have an operating temperature from 143 to 158° C.

By the above disclosed device, the steam, supplied through the steaming duct to the pressing elements 30, is overheated, after an expansion step following the outlet from the steaming drum 11.

Accordingly, the overheated steam is caused to impinge against the article being ironed with a high temperature, while eliminating any condensate materials, thereby properly ironing the trousers.

Owing to the above disclosed device, it is accordingly possible to fully iron the trousers pair also at the regions thereof affected by the gripping means.

The invention, as disclosed, is susceptible to several modifications and variations, all of which will come within the scope of the invention.

Moreover, all the constructional details can be replaced by other technically equivalent elements.

In practicing the invention, the used materials, as well as the contingent size and shapes, can be any, depending on requirements.

What is claimed is:

1. An ironing device, to be applied to ironing machines for ironing uncreased trousers, said ironing device including ironing means for ironing the bottom portions of said trousers, and comprising a supporting framework supporting at least an ironing head including supporting means for supporting said trousers at a pelvis level, and gripping means for gripping the bottom portions of said trousers, characterized in that said ironing device comprises a steaming drum, coupled to a heating circuit for heating said gripping means and to a steaming duct coupled to said gripping means.

2. An ironing device, according to claim 1, characterized in that said device comprises a steam manifold for delivery overheated steam, said steam manifold communicating with said steaming drum and gripping means.

3. An ironing device, according to claim 2, characterized in that said ironing device comprises, in said delivery manifold, a duct for conveying therethrough steam for heating said gripping means and a duct for conveying therethrough steam to be used for steaming operations.

4. An ironing device, according to claim 1, characterized in that said gripping means comprise a pressing element including a duct for recirculating heating steam and a steam outlet duct.

5. An ironing device, according to claim 4, characterized in that said steam outlet duct comprises a steam overheating circuit.

6. An ironing device, according to claim 4, characterized in that said steaming duct comprises a plurality of steaming outlet holes.

7. An ironing device, according to claim 1, characterized in that said device is applied to a machine for ironing uncreased trousers with iron means for ironing the bottom portions of the trousers, and being characterized in that said device comprises a supporting framework which comprises a single ironing head or two opposite ironing heads, or four or more ironing heads, which are evenly circumferentially distributed and are continuously movable.

8. An ironing device, according to claim 7, characterized in that at each ironing head are provided trousers supporting means for supporting said trousers at their pelvis region.

9. An ironing device, according to claim 1, characterized in that said steaming drum communicates with a steam inlet or supplying duct.

10. An ironing device, according to claim 9, characterized in that said steaming drum comprises a top portion including a plurality of solenoid valves, a number of said solenoid valves corresponding to a number of said ironing heads provided in said ironing machine.

11. An ironing device, according to claim 10, characterized in that said solenoid valves control a steaming duct.

12. An ironing device, according to claim 10, characterized in that said steaming drum comprises a steaming drum bottom coupled to a heating circuit including a steam outlet duct, provided for supplying steam to a delivery manifold.

13. An ironing device, according to claim 12, characterized in that said overheated steam delivery manifold conveys overheated steam to said gripping means and, more specifically, to a right and left pressing means of said gripping means.

14. An ironing device, according to claim 13, characterized in that in said circuit, said overheated steam is circulated under pressure inside one of said pressing elements and then exiting said pressing element, and returns to said manifold to be conveyed therefrom to the other pressing element, where said steam is circulated to heat it and then being returned to said manifold.

15. An ironing device, according to claim 14, characterized in that said from said manifold, said steam is conveyed to a condensate discharging duct, for discharging condensate to the outside environment.

16. An ironing device, according to claim 14, characterized in that said manifold comprises an inner steaming duct conveying said steam to said two pressing elements.

17. An ironing device, according to claim 16, characterized in that said two pressing elements comprise an inner overheating circuit for overheating said steam to convey it to the steam outlet holes arranged on the longitudinal extension of the pressing elements.

18. An ironing device, according to claim 17, characterized in that each pressing element is held in a heated condition by causing said overheated steam to pass through overheating duct supplied with steam at a pressure from 4 to 6 atm, and a temperature from 143° C. to 148° C.

19. An ironing device, according to claim 18, characterized in that said steam is supplied through said steaming duct to said pressing elements and is overheated upon an expansion thereof.

20. An ironing device, according to claim 1, characterized in that in said ironing device, said steam is caused to impinge against an article being ironed at a high temperature, thereby eliminating condensate materials therefrom.

* * * * *